US010938136B2

(12) United States Patent
Lybrand

(10) Patent No.: US 10,938,136 B2
(45) Date of Patent: Mar. 2, 2021

(54) SURFACE MOUNTED CARD EDGE CONTACT PAIR WITH PICK-UP CARRIER

(71) Applicant: AVX Corporation, Fountain Inn, SC (US)

(72) Inventor: Brent B. Lybrand, Fountain Inn, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 16/411,393

(22) Filed: May 14, 2019

(65) Prior Publication Data

US 2019/0372258 A1 Dec. 5, 2019

Related U.S. Application Data

(60) Provisional application No. 62/677,476, filed on May 29, 2018.

(51) Int. Cl.

| | |
|---|---|
| ***H01R 12/72*** | (2011.01) |
| ***H01R 12/57*** | (2011.01) |
| ***H01R 43/02*** | (2006.01) |
| ***H01R 43/20*** | (2006.01) |
| ***H01R 13/24*** | (2006.01) |

(52) U.S. Cl.

CPC ..... *H01R 12/722* (2013.01); *H01R 12/57* (2013.01); *H01R 13/2457* (2013.01); *H01R 43/0256* (2013.01); *H01R 43/205* (2013.01)

(58) Field of Classification Search

CPC ..... H01R 12/722; H01R 12/57; H01R 13/24
See application file for complete search history.

(56) References Cited

U.S. PATENT DOCUMENTS

| | | | | |
|---|---|---|---|---|
| 3,423,516 | A * | 1/1969 | Segerson | H01L 23/49562 174/526 |
| 4,158,745 | A * | 6/1979 | Keller | H01L 21/4842 174/16.3 |
| 5,156,552 | A * | 10/1992 | Zaderej | H05K 1/119 439/59 |
| 6,558,173 | B1 | 5/2003 | Choy | |
| 2008/0220625 | A1 | 9/2008 | Ligander | |
| 2010/0075534 | A1 | 3/2010 | Mtchedlishvili et al. | |
| 2010/0167570 | A1 | 7/2010 | Yang et al. | |
| 2014/0179167 | A1 | 6/2014 | Long et al. | |

OTHER PUBLICATIONS

International Search Report and Written Opinion in PCT/IB2019/054040 dated Oct. 4, 2019 (13 pages).

* cited by examiner

*Primary Examiner* — Xuong M Chung Trans
(74) *Attorney, Agent, or Firm* — Foley & Lardner LLP

(57) ABSTRACT

A card edge contact pair for electrically coupling printed circuit board assemblies is provided. The card edge contact pair includes a first contact body and a second contact body. The first contact body includes a first solder joint end and a first deflection end. The second contact body includes a second solder joint end and a second deflection end. The card edge contact pair further includes an integral carrier component. The integral carrier component is detachably coupled to the first contact body and the second contact body.

19 Claims, 10 Drawing Sheets

SURFACE MOUNTED CARD EDGE CONTACT PAIR WITH PICK-UP CARRIER

CROSS-REFERENCE TO RELATED APPLICATIONS

The present application claims priority to U.S. Provisional Application No. 62/677,476, filed May 29, 2018, which is incorporated by reference herein in its entirety.

FIELD

The present application relates generally to field of electrical contacts, and more particularly to a type of electrical contact pair used to connect printed circuit boards (PCBs) in a perpendicular orientation.

BACKGROUND

The following description is provided to assist the understanding of the reader. None of the information provided or references cited are admitted to be prior art.

Various types of connectors are used for forming electrical and mechanical connections between PCBs. These connectors can play a crucial role in achieving a design's size, cost, and performance constraints. Traditionally, to connect two PCBs in a perpendicular orientation, a minimum of two electrical contacts are required. Affixing the electrical contacts to the PCB can be a difficult and inefficient process, as failure to hold a tight tolerance between the electrical contacts can result in suboptimal mating between the two PCBs. Thus, an efficient and reliable contact pair that can be precisely mounted on the edge of a PCB is needed.

SUMMARY

The systems, methods, and devices of this disclosure each have several innovative aspects, no single one of which is solely responsible for the desirable attributes disclosed herein. One embodiment of the invention relates to a card edge contact pair for electrically coupling printed circuit board assemblies. The card edge contact pair includes a first contact body and a second contact body. The first contact body includes a first solder joint end and a first deflection end. The second contact body includes a second solder joint end and a second deflection end. The card edge contact pair further includes an integral carrier component. The integral carrier component is detachably coupled to the first contact body and the second contact body.

In an embodiment, the first deflection end and the second deflection end are shaped using a forming process.

In another embodiment, the card edge contact pair includes a joint component that couples the first solder joint end and the second solder joint end to the integral carrier component. In such an embodiment, the joint component is configured to detachably couple from the first contact body and the second contact body. Further, in such an embodiment, the card edge contact pair further includes a first score feature located at the intersection of the joint component and the first solder joint end, and a second score feature situated at the intersection of the joint component and the second solder joint end.

In an embodiment, the integral carrier component is oriented parallel to the first solder joint end and the second solder joint end.

A system includes a first printed circuit board assembly and a second printed circuit board assembly. The first printed circuit board assembly includes a first printed circuit board and a first card edge contact pair coupled to the first printed circuit board. The first card edge contact pair includes a first contact body, a second contact body, and an integral carrier component detachably coupled to the first contact body and the second contact body. The second printed circuit board assembly is oriented perpendicularly with respect to the first printed circuit board assembly. The second printed circuit board assembly includes a second printed circuit board with a slot feature. A first contact surface and a second contact surface are located proximate to the slot feature. When the first printed board is inserted into the slot feature of the second printed circuit board, the first contact body is coupled to the first contact surface, and the second contact body is coupled to the second contact surface.

In an embodiment, the first contact body and the second contact body each include a solder joint end and a deflection end. Moreover, the deflection ends are shaped using a forming process. In addition, the integral carrier component is oriented parallel to the solder joint ends.

In another embodiment, the first circuit board assembly includes a second card edge contact pair coupled to the first printed circuit board. The second card edge contact pair includes a third contact body and a fourth contact body. Moreover, the second printed circuit board assembly includes a third contact surface and a fourth contact surface. The third contact body couples to the third contact surface and the fourth contact body couples to the fourth contact surface.

Another embodiment of the invention relates to a method affixing a card edge contact pair to a printed circuit board assembly. The method includes removing a card edge contact pair from a packaging component. The card edge contact pair includes a first contact body and a second contact body detachably coupled to an integral carrier portion. The method further includes locating the card edge contact pair on a printed circuit board, fastening the card edge contact pair to the printed circuit board, and detaching the integral carrier portion from the first contact body and the second contact body.

In an embodiment, the first contact body and the second contact body each include a solder joint end and a deflection end. In addition, the deflection ends are shaped using a forming process. Moreover, locating the card edge contact pair on the printed circuit board includes aligning the solder joint ends with solder pads located on the printed circuit board.

In another embodiment, the method is performed at least in part by automated component placement equipment. Moreover, removing the card edge contact pair from the packaging component includes the automatic component placement equipment gripping the integral carrier portion by a vacuum device or a magnetic device.

In an embodiment, fastening the card edge contact pair to the printed circuit board includes a reflow solder process. In another embodiment, the packaging component includes tape and reel packaging.

DETAILED DESCRIPTION

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is a surface mounted card edge contact pair with an integral pick-up carrier. Such a contact pair may be used to mechanically and electrically couple two electrical current paths from a first printed circuit board (PCB) to a second PCB oriented in a direction perpendicular to the first PCB. The inclusion of the integral pick-up carrier allows the two contacts to be precisely located relative to one another for optimal functioning. Existing card edge contact pair designs often utilize separately placed contacts, which may float relative to each other during a solder reflow process. If a tight tolerance is not enforced on the contact spacing, the result may be a sub-optimal contact gap and electrical connection.

Figure 1:
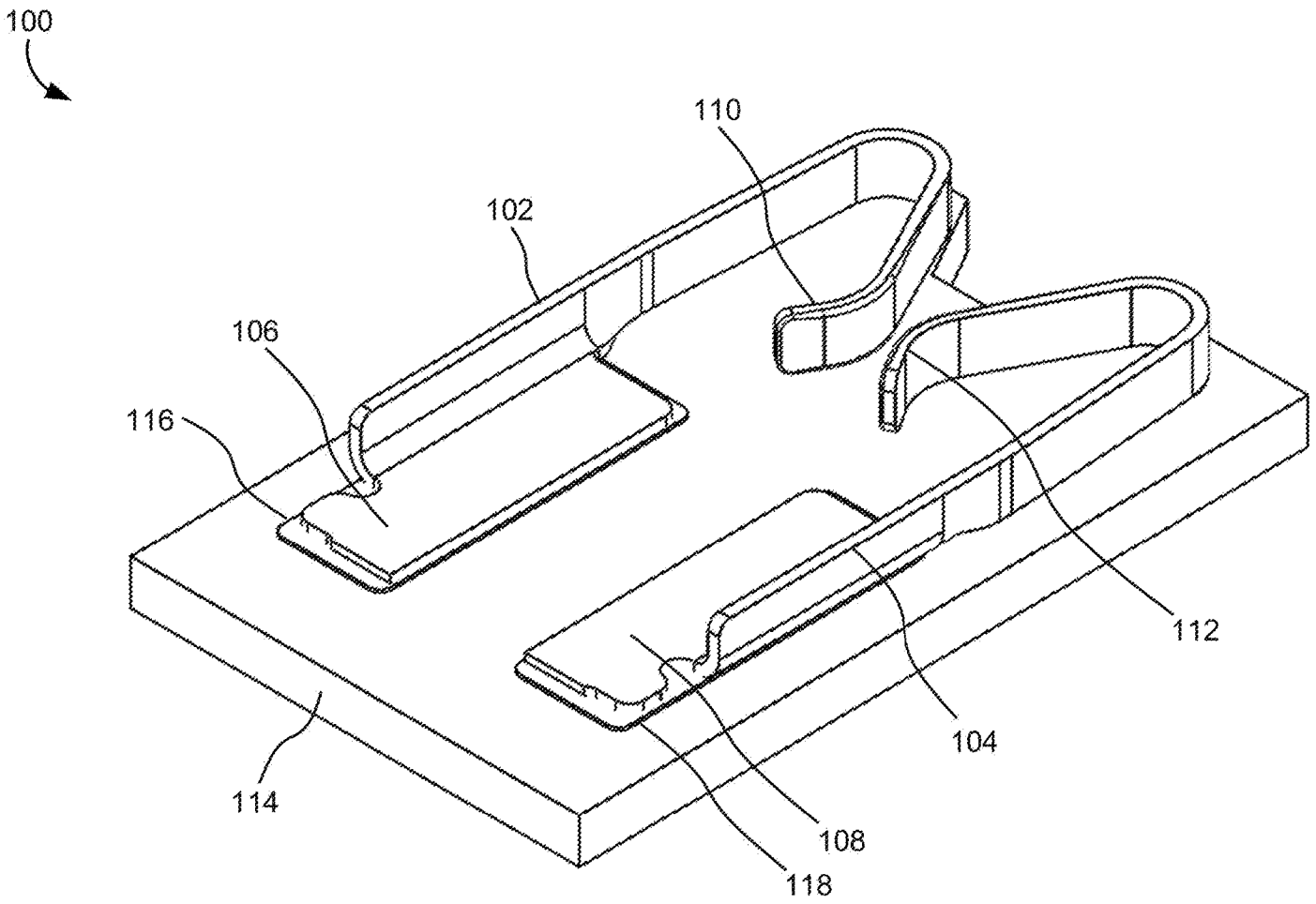
FIG. 1 depicts an isometric view of a card edge contact pair in accordance with an illustrative embodiment.

Referring to FIG. 1, a mounted card edge contact pair assembly 100 is depicted, according to an illustrative embodiment. The mounted card edge contact pair assembly 100 includes a first contact body 102 and a second contact body 104. In one embodiment, the first contact body 102 and the second contact body 104 are symmetric. First contact body 102 is shown to terminate at a first solder joint end 106 and a first deflection end 110, while second contact body 104 is shown to terminate at a second solder joint end 108 and a second deflection end 112. In various embodiments, the solder joint ends 106 and 108 have a substantially rectangular shape and are oriented perpendicularly relative to the deflection ends 110 and 112.

The deflection ends 110 and 112 may be shaped to apply and maintain compression force between the contact bodies 102 and 104 and the contact surfaces of the mating PCB to maintain the required electrical connections. As depicted in FIG. 1, deflection ends 110 and 112 may have a substantially hooked shape and may be bent backwards toward the solder joint ends 106 and 108. In some embodiments, the deflection ends 110 and 112 are shaped using a forming process, as opposed to a stamping process. Use of a forming process can result in a smoother mating interface surface than the mating interface surface provided by an edge-blanked contact.

The first contact body 102 and the second contact body 104 are shown to be mounted on a PCB 114 through a first solder pad 116 and a second solder pad 118. The PCB 114 may be fabricated from any suitable material (e.g., FR4) and may be any required number of layers. In an illustrative embodiment, PCB 114 is smaller than the mating PCB (described in further detail below with respect to FIGS. 2 and 3). The first solder pad 116 and the second solder pad 118 may have a substantially rectangular shape and may be formed using a layer of solder paste. The solder paste may be a mixture of powdered solder and flux that is configured to melt under a controlled heating process to permanently join the first contact body 102 and the second contact body 104 to the PCB 114. Further details regarding an illustrative embodiment of the PCB and solder pad geometry is included below with reference to FIG. 9.

First contact body 102 and second contact body 104 may be fabricated from any suitable conductive material, in any dimensions required to withstand the deflection forces generated as the contact pair assembly 100 is mated with a corresponding PCB assembly. In some embodiments, the first contact body 102 and the second contact body 104 are fabricated from gold-plated beryllium copper (BeCu). BeCu may be selected for its high deflection range and good fatigue resistance, while gold plating may enhance the conduction capabilities of the first contact body 102 and the second contact body 104. Gold plating is non-reactive as compared with other most other metals, and does not oxidize or rust in the presence of moisture and heat.

Figure 2:
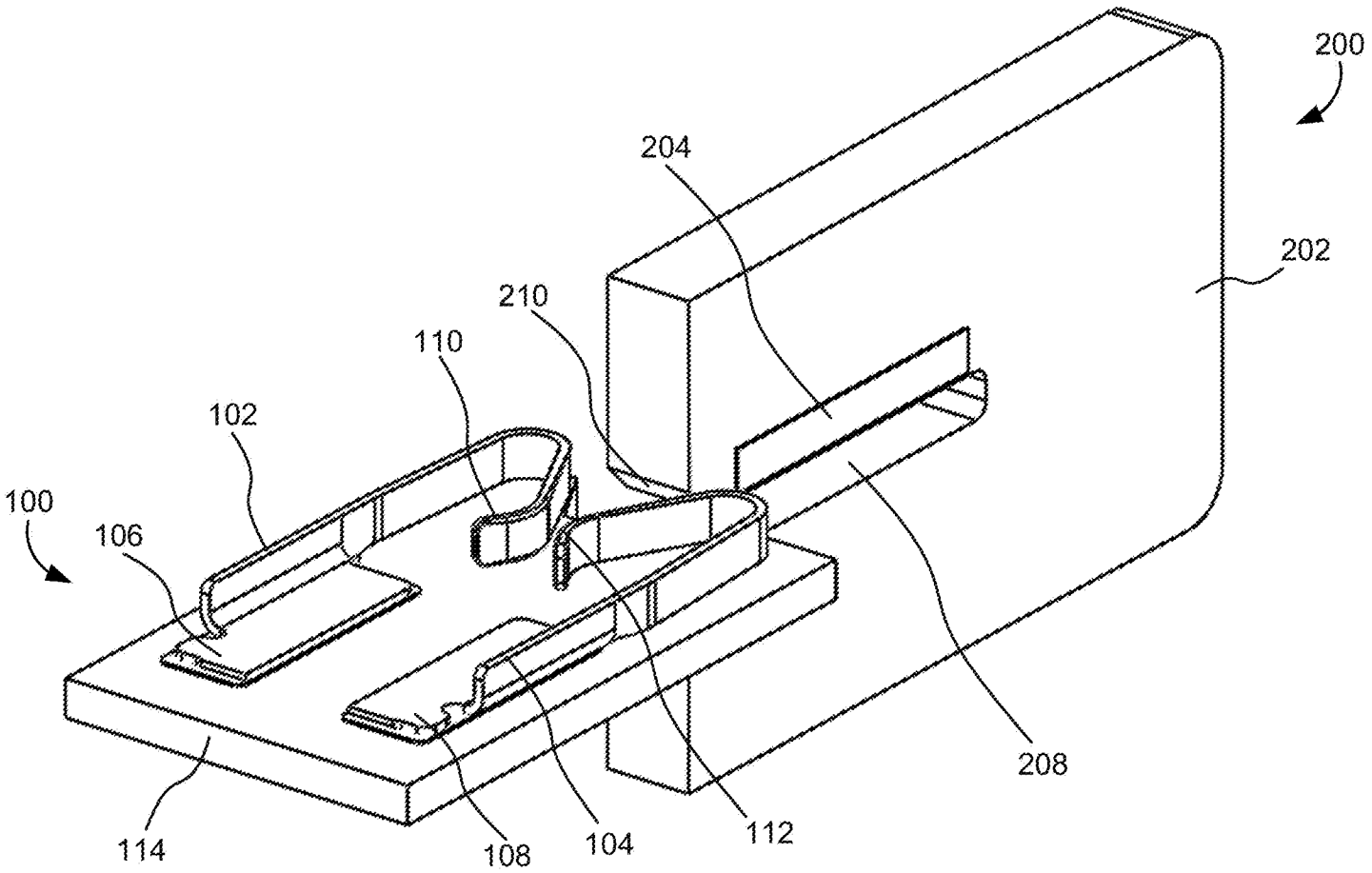
FIG. 2 depicts an isometric view of a card edge contact pair before engagement in accordance with an illustrative embodiment.
Figure 3:
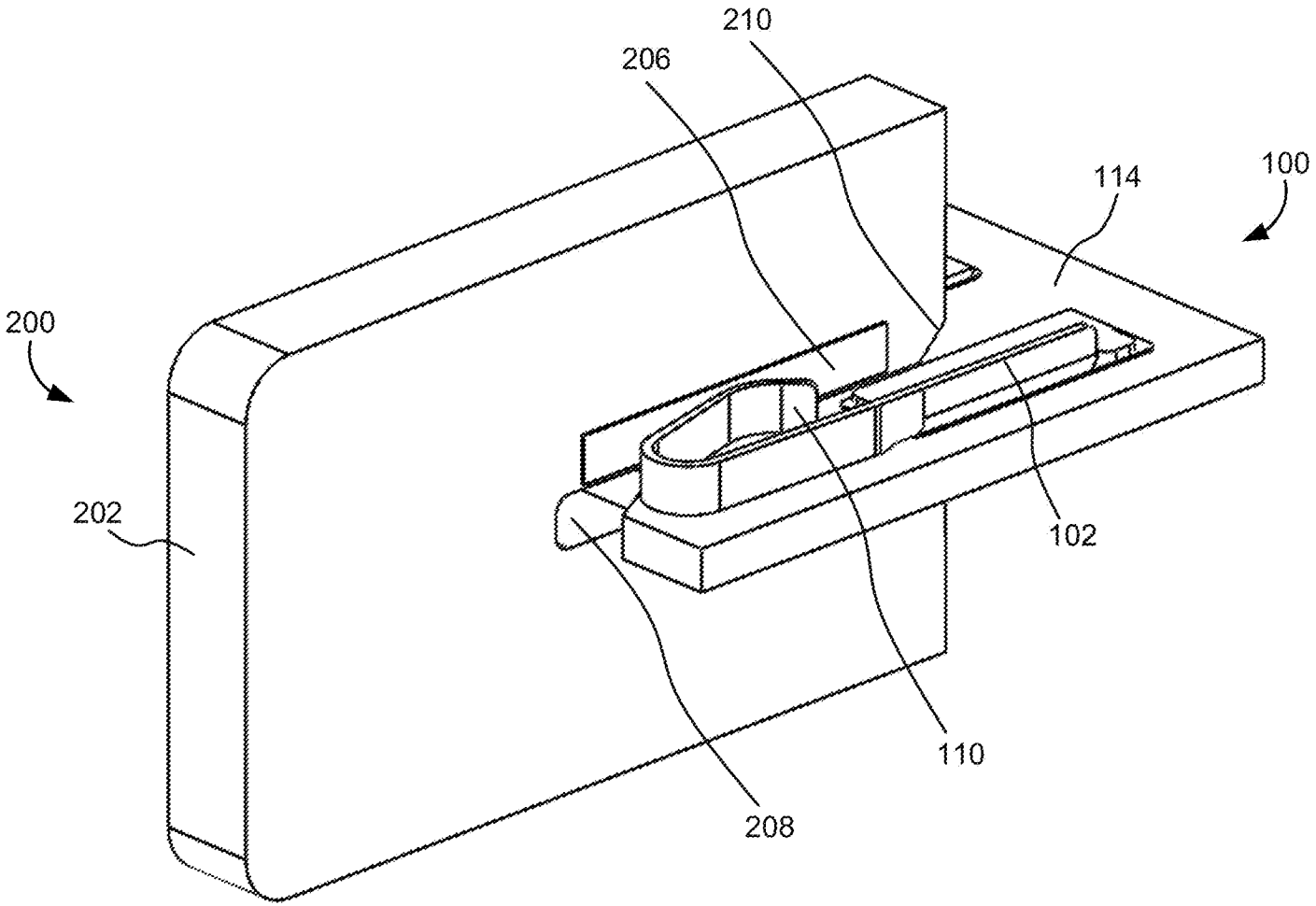
FIG. 3 depicts an isometric view of a card edge contact pair after engagement in accordance with an illustrative embodiment.

Referring now to FIGS. 2 and 3, the mounted card edge contact pair assembly 100 is shown prior and subsequent to engagement with a mating PCB assembly 200. Mating PCB assembly 200 is shown to include, among other components, a PCB 202 with a first contact surface 204 and a second contact surface 206. The contact surfaces 204 and 206 abut a slot feature 208. The width of the slot feature 208 may be selected such that the PCB 114 is able to be easily inserted into the slot feature 208. In some embodiments, the slot feature 208 is located proximate to one or more beveled or chamfered surfaces 210. The chamfered surfaces 210 eliminate sharp corners surrounding the slot feature 208 and may increase the ease of mating the mounted card edge contact pair assembly 100 with the mating PCB assembly 200.

The depth that the slot feature 208 extends into the PCB 202 may be selected such that the deflection ends 110 and 112 of the contact pair assembly 100 make full contact with the contact surfaces 204 and 206. As the deflection ends 110 and 112 slide over the contact surfaces 204 and 206, the deflection ends 110 and 112 deflect away from the center of the contact pair assembly 100. The first contact surface 204 and the second contact surface 206 may be fabricated from any suitable conductive material. For example, in some embodiments, the first and second contact surfaces 204 and 206 are gold plated.

Figure 4:
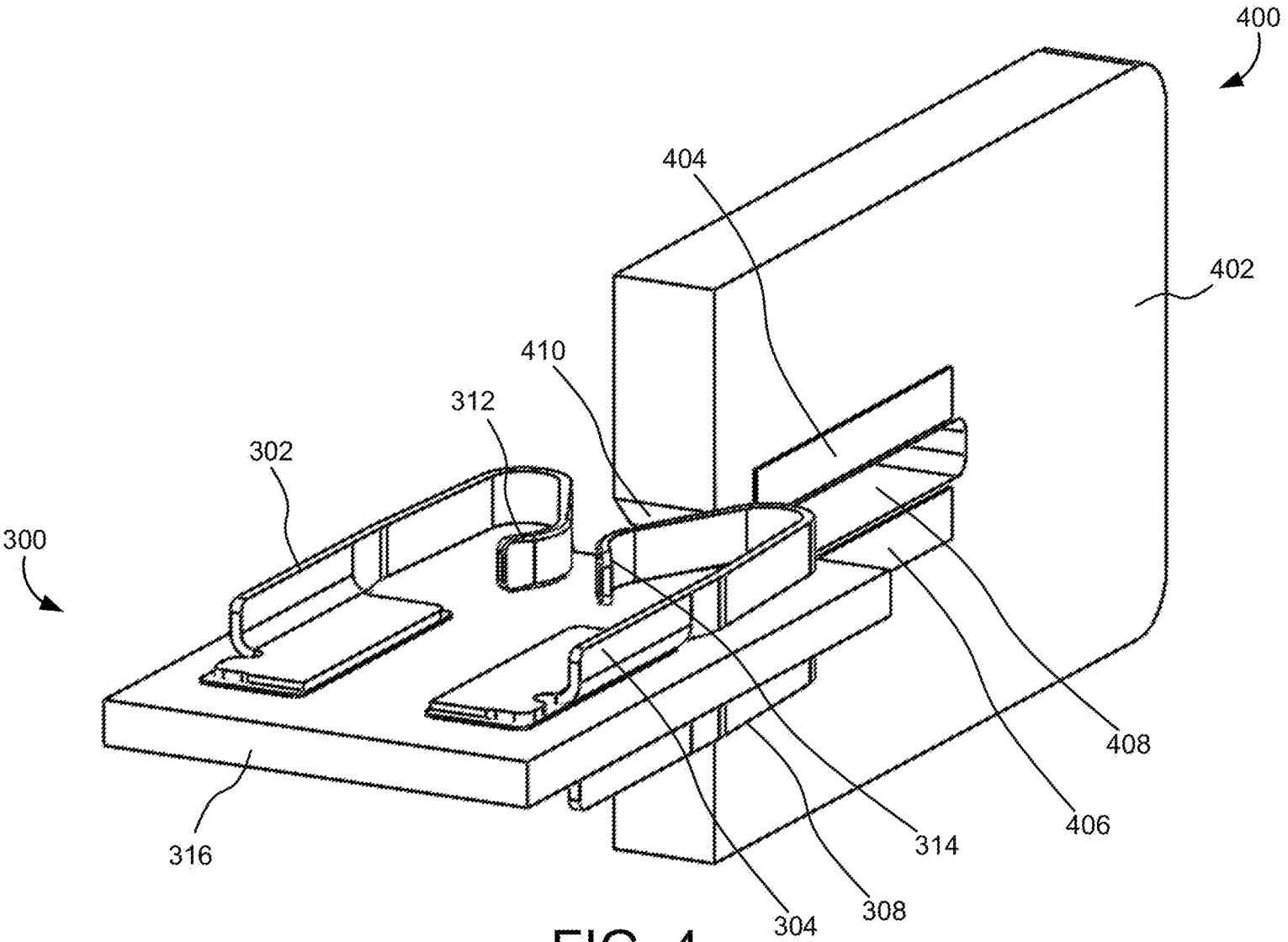
FIG. 4 depicts an isometric view of a dual card edge contact pair before engagement in accordance with an illustrative embodiment.
Figure 5:
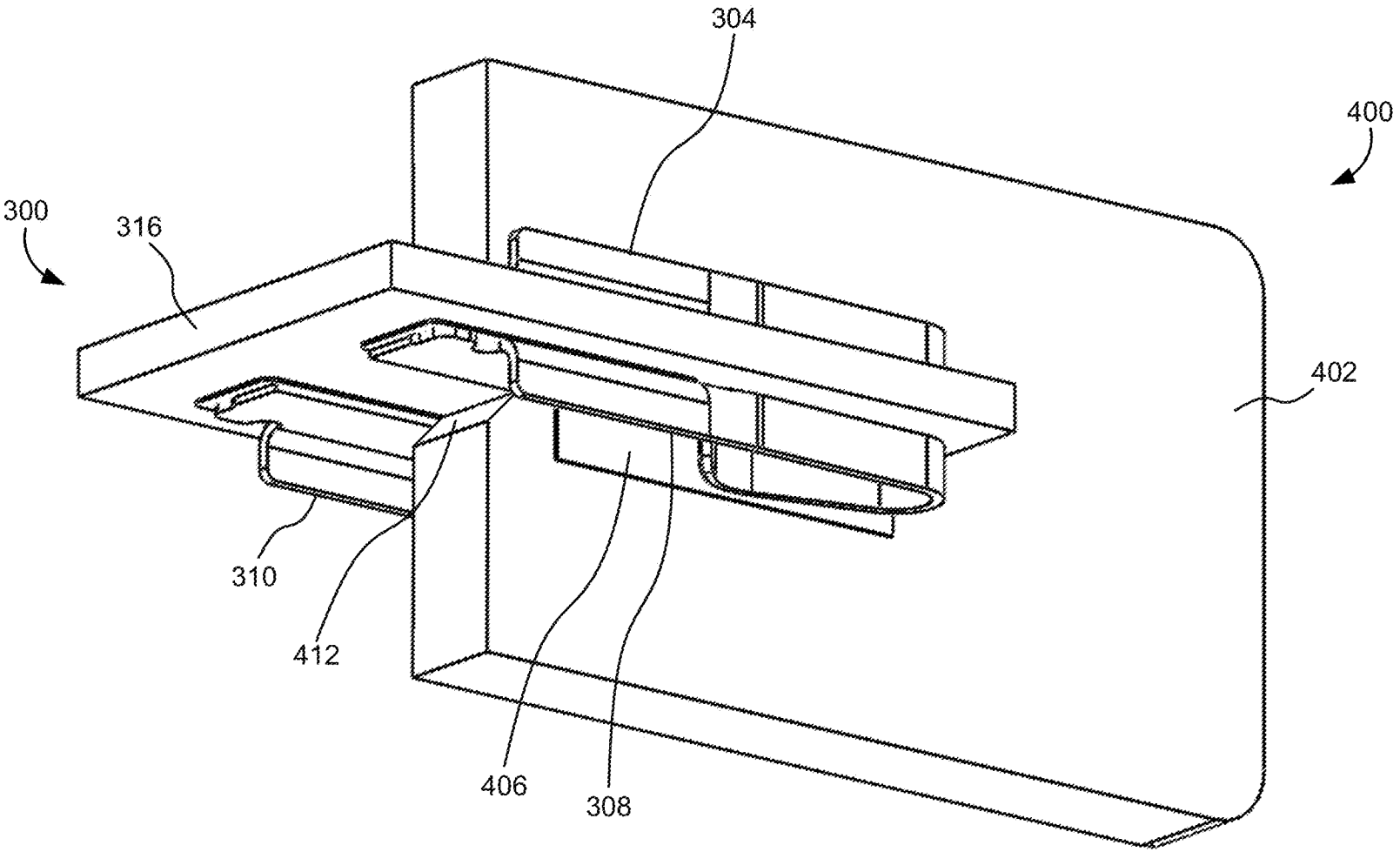
FIG. 5 depicts an isometric view of a dual card edge contact pair after engagement in accordance with an illustrative embodiment.

Turning now to FIGS. 4 and 5, a dual-mounted card edge contact pair assembly 300 is shown prior and subsequent to engagement with a mating PCB assembly 400. Similar to the contact pair assembly 100 described above, dual-mounted card edge contact pair assembly 300 is shown to include a first contact body 302 with a first deflection end 312 and a second contact body 304 with a second deflection end 314. The first contact body 302 and the second contact body 304 are shown to be surface mounted to PCB 316. Dual-mounted card edge contact pair assembly 300 is further shown to include a third contact body 308 and a fourth contact body 310, thereby increasing the number of potential electrical connections between assemblies 300 and 400 from two to four.

Mating PCB assembly 400 is shown to include a PCB 402 with a first contact surface 404 and a second contact surface 406 situated above and below a slot feature 408 (third and fourth contact surfaces, not shown, may be located on the opposite side of PCB 402). In various embodiments, contact surfaces 404 and 406 are identical or substantially similar to contact surfaces 204 and 206, described above with reference to FIGS. 2-3. Mating PCB assembly 400 may also include multiple chamfered surfaces 410 and 412 proximate to the slot feature 408. Chamfered surfaces 410 and 412 may aid in the alignment and insertion of dual-mounted card edge contact pair assembly 300 into the slot feature 408 mating PCB assembly 400.

Figure 6:
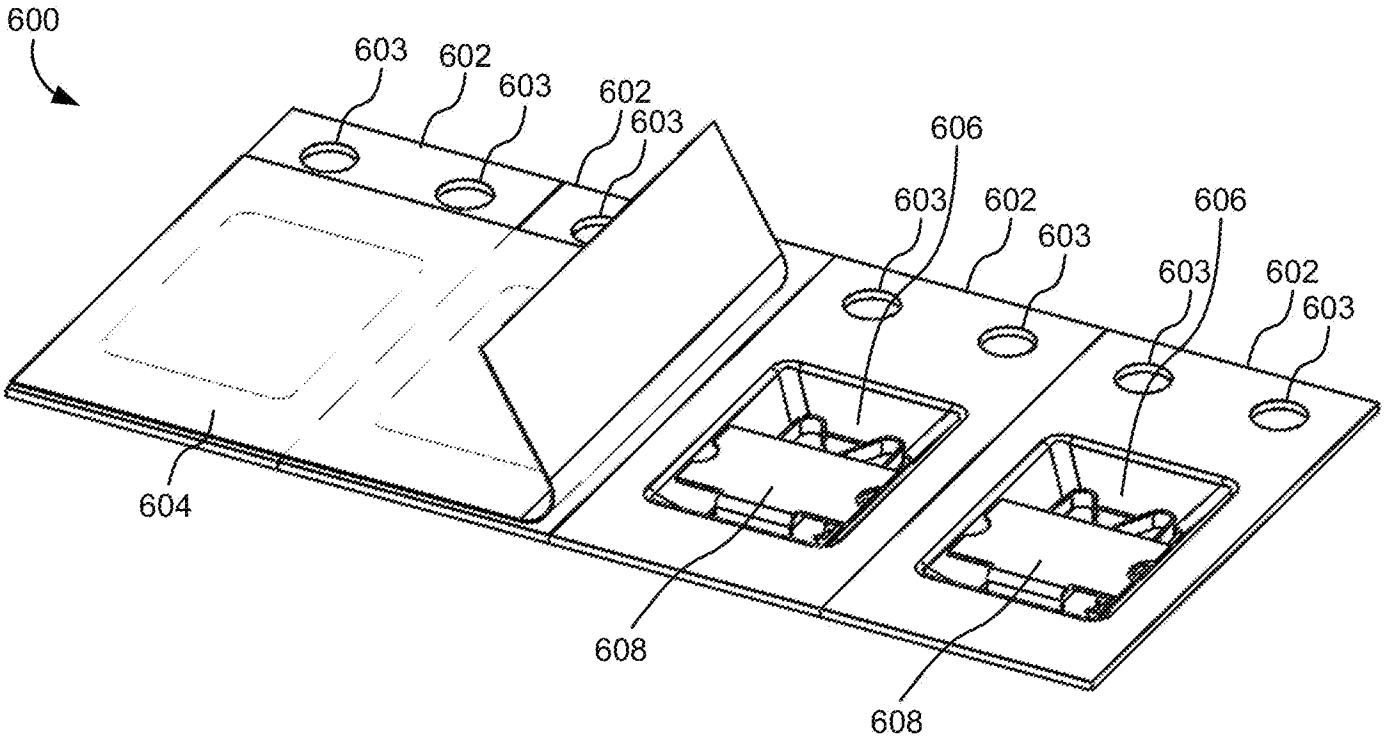
FIG. 6 depicts an isometric view of card edge contact pairs as shipped in accordance with an illustrative embodiment.

Referring now to FIG. 6, a card edge contact pair shipping assembly 600 is depicted, according to an illustrative embodiment. As shown, shipping assembly 600 is shown to comprise tape and reel packaging with embossed carrier tape segments 602 sealed by a cover tape 604. Tape and reel packaging is utilized with automated placement equipment, also known as "pick-and-place" equipment, that is capable of placing thousands of surface mount components on a PCB per hour. In order to facilitate the high speed placement of components, each carrier tape segment 602 is shown to include multiple sprocket holes 603 that are utilized by a feeder component of an automated placement machine to advance the carrier tape segments 602 into the machine. The properties of cover tape 604 (e.g., peel back force) may be selected such that cover tape 604 remains adhered to carrier tape segments 602 under normal handling, while at the same time being removable by the automated placement equipment. Each embossed carrier tape segment 602 is shown to include a pocket 606 that partially encapsulates a card edge contact pair in its shipping configuration 608. The size of pocket 606 may be chosen such that the contact bodies of contact pair 608 are prevented from excessive movement and damage during handling and storage procedures.

Figure 8:
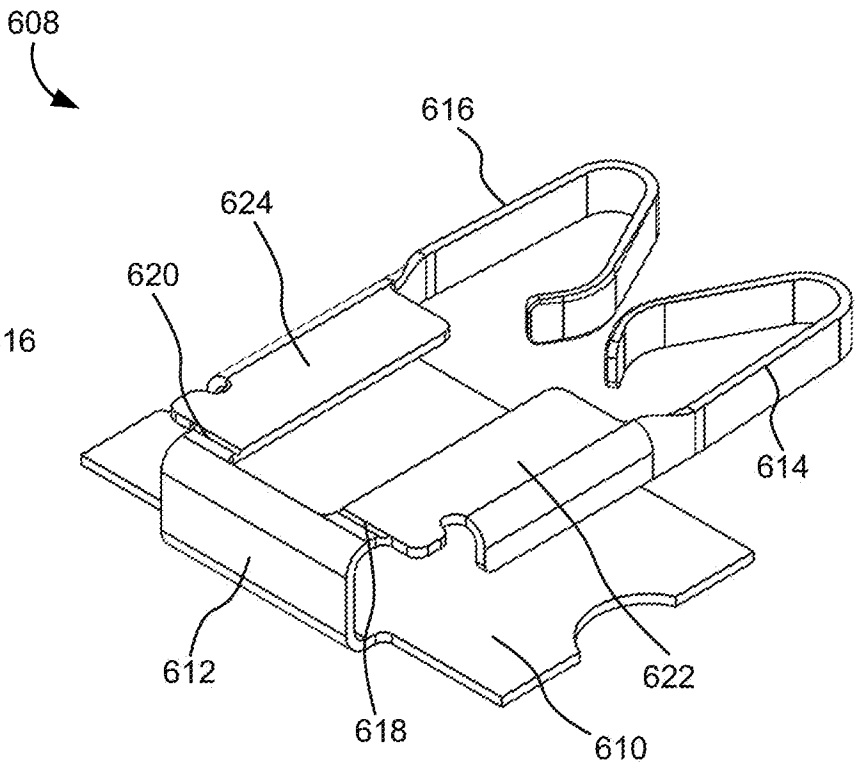
FIG. 8 depicts another isometric view of a card edge contact pair as shipped in accordance with an illustrative embodiment.
Figure 7:
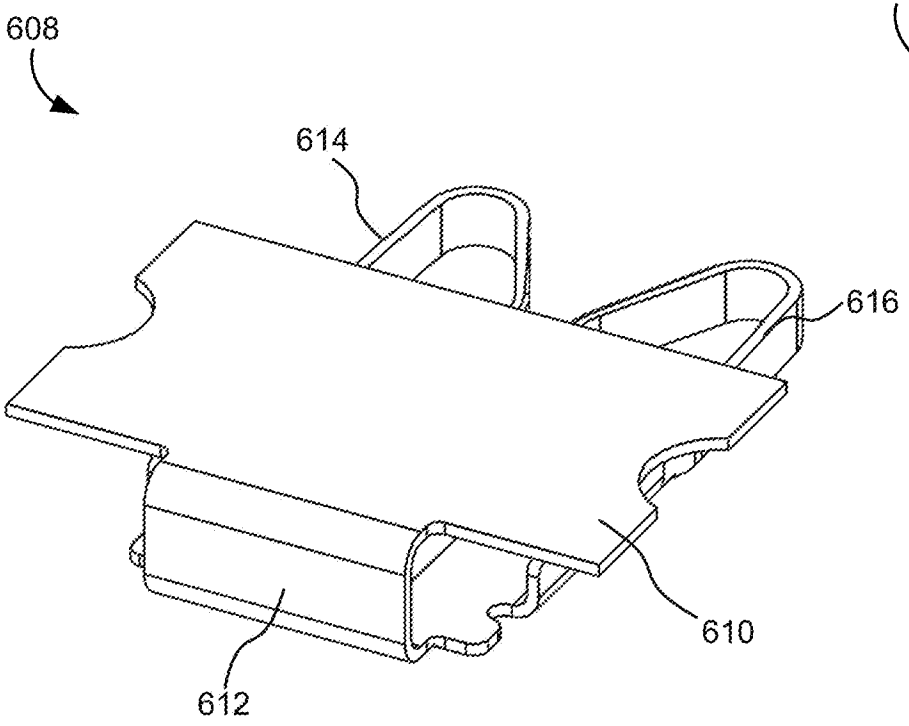
FIG. 7 depicts an isometric view of a card edge contact pair as shipped in accordance with an illustrative embodiment.

Turning now to FIGS. 7 and 8, isometric views of the card edge contact pair in the shipping configuration 608 are depicted, according to illustrative embodiments. As shown, the contact pair 608 includes an integral carrier portion 610 connected to a first contact body 614 and a second contact body 616 by a carrier joint 612. The integral carrier portion 610 may be utilized to remove the contact pair 608 from packaging materials and to maintain a desired spacing between the first contact body 614 and the second contact body 616 during a process of affixing the contact pair 608 to a PCB. In various embodiments, the integral carrier portion 610 and the carrier joint 612 are fabricated from the same material or materials as the first contact body 614 and the second contact body 616. In some embodiments, the integral carrier portion 610 may have a substantially rectangular shape and may be oriented parallel to the solder joint ends 622 and 624 of the contact bodies 614 and 616. In other embodiments, integral carrier portion 610 may have any desired shape that permits the gripping mechanism of the automatic placement equipment (e.g., a vacuum gripping mechanism, a multi-finger gripping mechanism, a magnetic gripping mechanism) to remove the contact pair 608 from the packaging materials.

Card edge contact pair 608 is further shown to include a first score feature 618 situated between the intersection of the first contact body 614 and the carrier joint 612, and a second score feature 620 situated between the intersection of the second contact body 616 and the carrier joint 612. Once card edge contact pair 608 has been removed from packaging materials and is located on a PCB (e.g., using a soldering process), the integral carrier portion 610 and the carrier joint 612 may be detached from the first contact body 614 and the second contact body 616, resulting in fully separate yet precisely located contact bodies 614 and 616. First score feature 618 and second score feature 620 may increase the ease of detaching the integral carrier portion 610 and the carrier joint 612 from the contact bodies 614 and 616 by providing clean lines along which the carrier joint 612 can be detached from the contact bodies 614 and 616. In various embodiments, integral carrier portion 610 and carrier joint 612 may be detached from contact bodies 614 and 616 via any suitable manual or automatic process. For example, detaching the integral carrier portion 610 and carrier joint 612 may comprise rotating the integral carrier portion 610 relative to the contact bodies 614 and 616 until the integral carrier portion 610 and carrier joint 612 snap free of the contact bodies 614 and 616 along the first score feature 618 and the second score feature 620.

Figure 10:
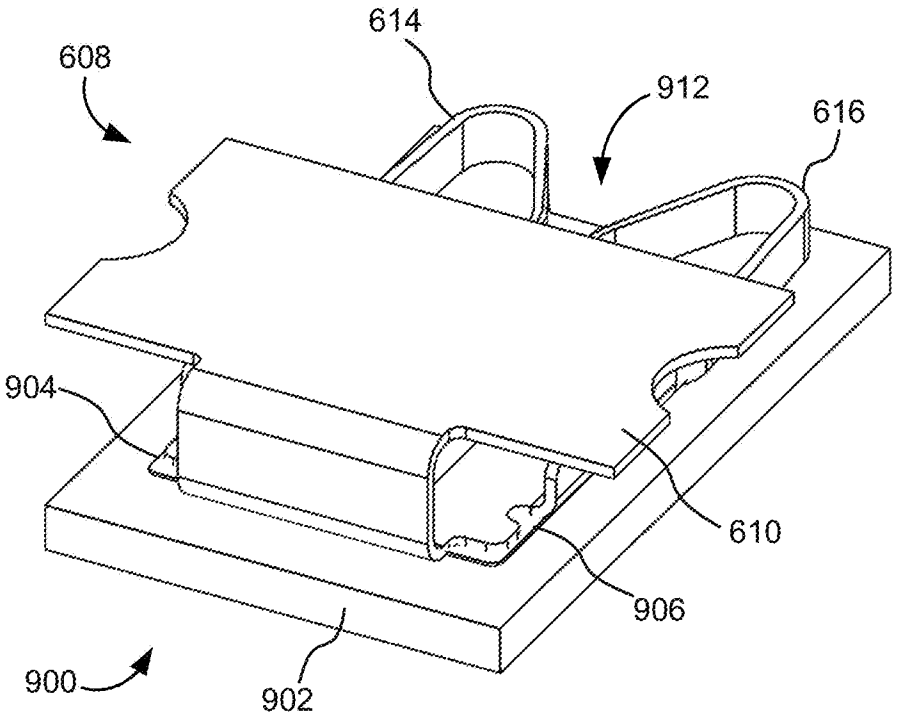
FIG. 10 depicts an isometric view of a mounted card edge contact pair as shipped in accordance with an illustrative embodiment.
Figure 9:
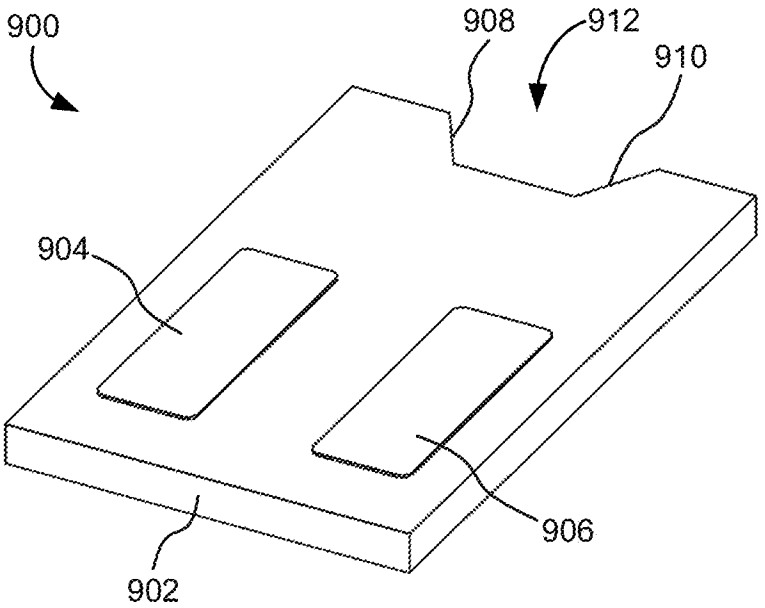
FIG. 9 depicts an isometric view of a printed circuit board solder pad configuration in accordance with an illustrative embodiment.

Referring now to FIG. 9, an illustrative embodiment of a PCB assembly 900 that can be utilized in a card edge contact pair assembly is depicted. For example, in some embodiments, PCB 902 is identical or substantially similar to PCB 114, and solder pads 904 and 906 are identical or substantially similar to solder pads 116 and 118, each of which is described above with reference to FIG. 1. PCB assembly 900 is further shown to include a first chamfered surface 908 and a second chamfered surface 910 proximate to a notch feature 912. Notch feature 912 may aid in aligning the PCB assembly 900 with a slot feature in a mating PCB assembly. Turning now to FIG. 10, an illustrative embodiment of the card edge contact pair 608 attached to the PCB assembly 900 is depicted. As shown, the first contact body 614 may be coupled to the solder pad 904, while the second contact body 616 may be coupled to the solder pad 906. Integral carrier portion 610 may be situated above the contact bodies 614 and 616 in preparation for a detachment process.

Figure 11:
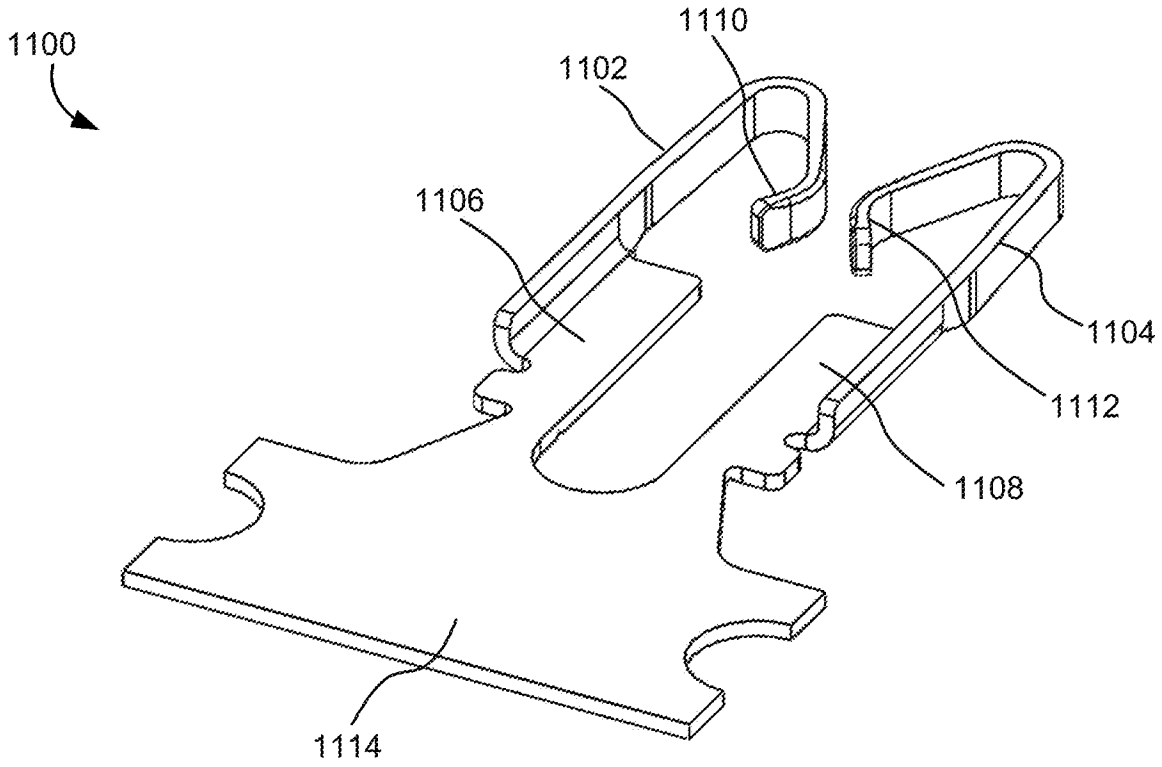
FIG. 11 depicts an isometric view of a card edge contact pair as shipped in accordance with another illustrative embodiment.

Referring now to FIG. 11, an alternative design for a card edge contact pair in its shipping configuration 1100 is depicted. Similar to the contact pair described in FIGS. 1-10 above, contact pair 1100 is shown to include a first contact body 1102 that terminates in a first solder joint end 1106 and a first deflection end 1110, and a second contact body 1104 that terminates in a second solder joint end 1108 and a second deflection end 1112. However, in contrast to the contact pair 608, contact pair 1100 is shown to include an integral carrier portion 1114 extending from and connecting the first contact body 1102 to the second contact body 1104 in the same plane as the first solder joint end 1106 and the second solder joint end 1108. Use of contact pair 1100 may be preferred where PCB space permits, as the stamping process required to fabricate contact pair 1100 is simpler than the stamping process required to fabricate contact pair 608. In some embodiments, the integral carrier portion 1114 may be detached from the first contact body 1102 and the second contact body 1104 once the contact bodies 1102 and 1104 are affixed to the PCB. However, in other embodiments, the first contact body 1102 and the second contact body 1104 are electrically common, and the integral carrier portion 1114 may remain permanently coupled to the first contact body 1102 and the second contact body 1104.

Figure 12:
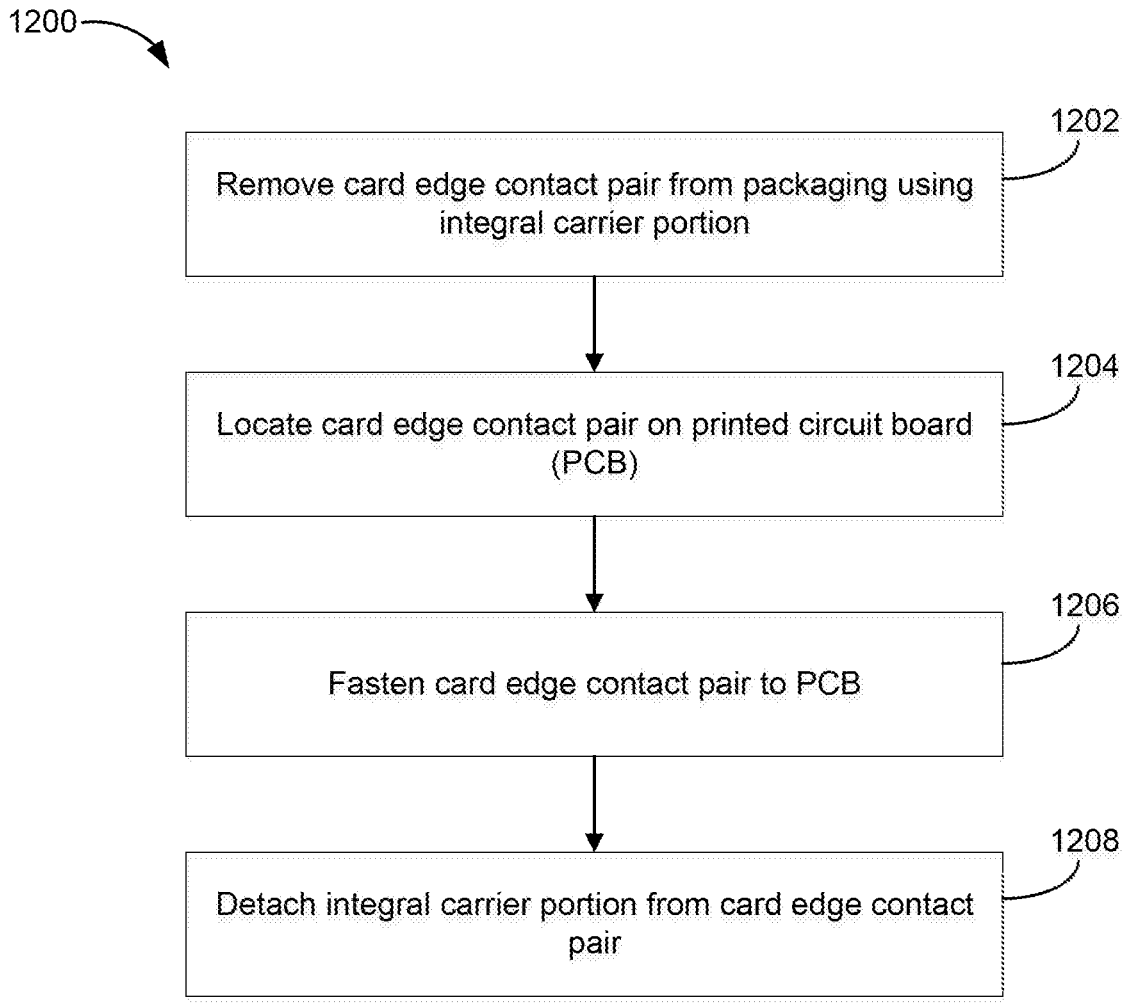
FIG. 12 depicts a method of affixing a card edge contact pair to a PCB in accordance with an illustrative embodiment.

FIG. 12 depicts a method 1200 of affixing a card edge contact pair to a PCB in accordance with an illustrative embodiment. In some embodiments, the method 1200 is performed at least partially by automated placement equipment, described above with reference to FIG. 6. In an operation 1202, a card edge contact pair is removed from tape and reel packaging. In some embodiments, the contact pair is identical or substantially similar to contact pair 608, and the tape and reel packaging is identical or substantially similar to embossed carrier tape segment 602 and cover tape 604, described above with reference to FIG. 6. For example, the contact pair 608 may be removed from the embossed carrier tape segment 602 by the integral carrier portion 610 using the gripping mechanism (e.g., a vacuum mechanism, a magnetic mechanism) of the automatic placement equipment.

In an operation 1204, the contact pair is located on a PCB. In some embodiments, the PCB is identical or substantially similar to PCB assembly 900, described above with reference to FIG. 9. For example, the solder joint ends 622 and 644 may be positioned to align with the solder pads 904 and 906. In an operation 1206, the contact pair is fastened to the PCB. In some embodiments, the fastening is completed using a reflow solder process. For example, the contact pair and PCB assembly may pass through a reflow oven that heats the assembly and causes the solder pads 904 and 906 to melt (i.e., reflow) and wet to the PCB 902 and the first contact body 614 and the second contact body 616 to form soldered surface mount connections.

In an operation 1208, the integral carrier portion is detached from the card edge contact pair. In some embodiments, features of the contact pair may aid in the detachment operation. For example, the integral carrier portion 610 and the joint portion 612 may be detached from the contact bodies 614 and 616 of the contact pair 608 along the first score feature 618 and the second score feature 620. In some embodiments, method 1200 does not include operation 1208. For example, if the card edge contact pair is identical or substantially similar to contact pair 1100, described above with reference to FIG. 11, and the first contact body 1102 and the second contact body 1104 are electrically common, the integral carrier portion 1114 may remain permanently affixed to the first contact body 1102 and the second contact body 1104.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A card edge contact pair for electrically coupling printed circuit board assemblies, the card edge contact pair comprising:

a first contact body, the first contact body including a first solder joint end and a first deflection end;

a second contact body, the second contact body including a second solder joint end and a second deflection end; and an integral carrier component that is detachably coupled to the first contact body and the second contact body;

wherein the first deflection end and the second deflection end comprise substantially hooked shapes that apply and maintain a compression force between the first contact body and the second contact body; and wherein the first solder joint end extends along a length of a first main body portion of the first contact body such that the first solder joint end extends from an area proximate the integral carrier component toward the first deflection end.

2. The card edge contact pair of claim 1, wherein the first deflection end and the second deflection end are shaped using a forming process.

3. The card edge contact pair of claim 1, wherein the card edge contact pair further comprises a joint component that couples the first solder joint end and the second solder joint end to the integral carrier component.

4. The card edge contact pair of claim 3, wherein the joint component is further configured to detachably couple from the first contact body and the second contact body.

5. The card edge contact pair of claim 4, wherein the card edge contact pair further comprises a first score feature situated at the intersection of the joint component and the first solder joint end, and a second score feature situated at the intersection of the joint component and the second solder joint end.

6. The card edge contact pair of claim 1, wherein the integral carrier component is oriented parallel to the first solder joint end and the second solder joint end.

7. A system comprising:

a first printed circuit board assembly, comprising:

a first printed circuit board having a first circuit board surface and a second circuit board surface opposite the first circuit board surface; and a first card edge contact pair coupled to the first printed circuit board and comprising a first contact body, a second contact body, and an integral carrier component detachably coupled to the first contact body and the second contact body, and wherein the first contact body and the second contact body each comprise a solder joint end coupled to the first circuit board surface;

a second printed circuit board assembly oriented perpendicularly with respect to the first printed circuit board assembly, the second printed circuit board assembly comprising:

a second printed circuit board comprising a slot feature; and a first contact surface and a second contact surface, the first and second contact surfaces located proximate to the slot feature;

wherein the first contact body is configured to couple to the first contact surface and the second contact body is configured to couple to the second contact surface when the first printed circuit board is inserted into the slot feature of the second printed circuit board.

8. The system of claim 7, wherein the first contact body and the second contact body each comprise a deflection end opposite the solder joint end.

9. The system of claim 8, wherein the deflection ends are coupled to the first and second contact surfaces on opposite sides of the second printed circuit board when the first printed circuit board is inserted into the slot feature of the second printed circuit board.

10. The system of claim 8, wherein the integral carrier component is oriented parallel to the solder joint ends.

11. The system of claim 7, wherein the first circuit board assembly further comprises a second card edge contact pair coupled to the first printed circuit board and comprising a third contact body and a fourth contact body.

12. The system of claim 11, wherein the second printed circuit board assembly further comprises a third contact surface and a fourth contact surface and wherein the third contact body is configured to couple to the third contact surface and the fourth contact body is configured to couple to the fourth contact surface.

13. A method of affixing a card edge contact pair to a printed circuit board assembly; the method comprising:

removing a card edge contact pair from a packaging component, the card edge contact pair comprising a first contact body and a second contact body detachably coupled to an integral carrier portion, wherein the first contact body and the second contact body each comprise a solder joint end and a deflection end;

locating the card edge contact pair on a printed circuit board such that a length of the first contact body between the solder joint end and the deflection end extends parallel to a surface of the printed circuit board;

fastening the card edge contact pair to the printed circuit board such that the solder joint end of the first contact body and the solder joint end of the second contact body are coupled to a same surface of the printed circuit board; and detaching the integral carrier portion from the first contact body and the second contact body.

14. The method of claim 13, wherein the deflection ends are shaped using a forming process.

15. The method of claim 13, wherein locating the card edge contact pair on the printed circuit board comprises aligning the solder joint ends with solder pads located on the printed circuit board.

16. The method of claim 13, wherein the method is performed at least in part by automated component placement equipment.

17. The method of claim 15, wherein removing the card edge contact pair from the packaging component comprises the automatic component placement equipment gripping the integral carrier portion by at least one of a vacuum device and a magnetic device.

18. The method of claim 13, wherein fastening the card edge contact pair to the printed circuit board comprises a reflow solder process.

19. The method of claim 13, wherein the packaging component comprises tape and reel packaging.

* * * * *